US005833146A

United States Patent [19]

Hefler

[11] Patent Number: 5,833,146

[45] Date of Patent: Nov. 10, 1998

[54] VALVE ASSEMBLY WITH COUPLED SEATS AND FUEL INJECTOR USING SAME

[75] Inventor: Gregory W. Hefler, Chillicothe, Ill.

[73] Assignee: Caterpillar Inc., Peoria, Ill.

[21] Appl. No.: 709,934

[22] Filed: Sep. 9, 1996

[51] Int. Cl.[6] ..... F02M 47/02

[52] U.S. Cl. ..... 239/533.8; 239/533.2; 251/129.14

[58] Field of Search ..... 239/93, 94, 97, 239/533.2, 533.3, 533.8, 533.9, 900, 96; 251/129.14; 137/625.64, 625.65

[56] References Cited

U.S. PATENT DOCUMENTS

| | | | |
|---|---|---|---|
| 4,379,524 | 4/1983 | Andrews | 239/533.8 |
| 4,510,796 | 4/1985 | Kampichler | 73/119 |
| 4,706,625 | 11/1987 | Meistrick et al. | 123/321 |
| 4,825,830 | 5/1989 | Elsbett et al. | 123/300 |
| 4,951,703 | 8/1990 | Brehm et al. | 239/900 X |
| 4,962,887 | 10/1990 | Matsuoka | 239/533.8 X |
| 4,997,133 | 3/1991 | Ausiello et al. | 239/96 X |
| 5,072,709 | 12/1991 | Long et al. | 123/446 |
| 5,135,027 | 8/1992 | Miki et al. | 251/129.14 X |
| 5,150,684 | 9/1992 | Jun | 123/446 |
| 5,154,350 | 10/1992 | Ausiello et al. | 239/533.8 X |
| 5,160,116 | 11/1992 | Sugiura et al. | 251/129.14 |
| 5,211,549 | 5/1993 | Kraemer | 417/499 |
| 5,443,209 | 8/1995 | Vanallsburg | 239/90 |
| 5,464,156 | 11/1995 | Ricco et al. | 239/533.8 X |

*Primary Examiner*—Andres Kashnikow
*Assistant Examiner*—Steven J. Ganey
*Attorney, Agent, or Firm*—Liell & McNeil

[57] ABSTRACT

A valve assembly with coupled seats includes a first body with a first annular valve seat and a pin bore centered about an axis. A second body is attached to the first body and has a second annular valve seat centered about the axis and located in a position opposite to the first annular valve seat. A ball is positioned to move between the annular valve seats. A pin is mounted to move in the pin bore along the axis such that one end can contact the ball to move the same. The pin bore along with the annular valve seats are coupled by providing one of the first body and the second body with a locating bore centered on the axis. The other of the first body and the second body has a cylindrical portion substantially parallel to the axis and sized to be tightly received in the locating bore. The valve assembly was developed for use with a solenoid as a control valve in a fuel injector.

20 Claims, 3 Drawing Sheets

VALVE ASSEMBLY WITH COUPLED SEATS AND FUEL INJECTOR USING SAME

TECHNICAL FIELD

The present invention relates generally to fuel injectors, and more particularly to fuel injector valve assemblies having geometrically coupled valve seats.

BACKGROUND ART

Known hydraulically-actuated fuel injection systems and/or components are shown, for example, in U.S. Pat. No. 5,121,730 issued to Ausman et al. on Jun. 16, 1992; U.S. Pat. No. 5,271,371 issued to Meints et al. on Dec. 21, 1993; and U.S. Pat. No. 5,297,523 issued to Hafner et al. on Mar. 29, 1994. In these hydraulically actuated fuel injectors, a spring biased needle check opens to commence fuel injection when pressure is raised by an intensifier piston/plunger assembly to a valve opening pressure. The intensifier piston is acted upon by a relatively high pressure actuation fluid, such as engine lubricating oil, when a solenoid driven actuation fluid control valve opens the injector's high pressure inlet. Injection is ended by deactivating the solenoid to release pressure above the intensifier piston. This in turn causes a drop in fuel pressure causing the needle check to close under the action of its return spring and end injection. One innovation that has been introduced recently is to control the opening and closing of the nozzle outlet by controlling exposure of the end of the needle valve member to either low or high pressure, respectively. This innovation is more thoroughly discussed in co-owned U.S. Pat. No. 5,463,996 entitled HYDRAULICALLY-ACTUATED FLUID INJECTOR HAVING PRE-INJECTION PRESSURIZABLE FLUID AND DIRECT-OPERATED CHECK and its progeny applications and patents.

The initiation of an injection event in all these hydraulically-actuated fuel injectors is started by energizing a solenoid to move an actuation fluid control valve to open the high pressure actuation fluid inlet to the injector. While some versions of this actuation fluid control valve utilize a poppet valve member or a spool valve member attached to the armature of a solenoid, other versions utilize a simple pin attached to the solenoid to move a ball between opposing valve seats. In order to prevent the possible breakage of the pin in these control valve assemblies, it is necessary that the bore guiding the pin as well as the two valve seats be closely aligned along a common axis. The potential for pin breakage is important in fuel injectors utilizing control valves of this type since the pin must necessarily be relatively small and must be able to withstand the pounding of many impacts per second with the ball and seats. Any misalignment creates a side force on the pin that eventually will lead to breakage.

The present invention is directed to improving valve assemblies having a pin and a ball trapped between opposing seats, and to improving fuel injectors that utilize such valve assemblies.

DISCLOSURE OF THE INVENTION

In one embodiment of the present invention, a valve assembly includes a first body with a first annular valve seat and a pin bore centered about an axis. A second body is attached to the first body and has a second annular valve seat centered about the axis and located in a position opposite to the first annular seat. A ball is positioned to move between the first annular valve seat and the second annular valve seat, and the pin is mounted to move in the pin bore along the axis such that it can contact and move the ball. One of the first body and the second body has a locating bore centered on the axis, and the other of the first body and second body has a part sized to be tightly received in the locating bore.

In another embodiment of the present invention, the previously described valve assembly is incorporated into a fuel injector having an injector body that includes a nozzle chamber that opens to a nozzle outlet. A hydraulic means within the injector body pressurizes fuel in the nozzle chamber. A needle valve member is positioned to reciprocate in the nozzle chamber between an opened position in which the nozzle outlet is open and a closed position in which the nozzle outlet is closed.

One object of the present invention is to improve the alignment between components of a valve assembly.

Another object of the present invention is to minimize pin breakage in valve assemblies due to misalignment.

Still another object of the present invention is to improve fuel injectors that utilize valve assemblies requiring close alignment of their components.

BEST MODE FOR CARRYING OUT THE INVENTION

Figure 1:
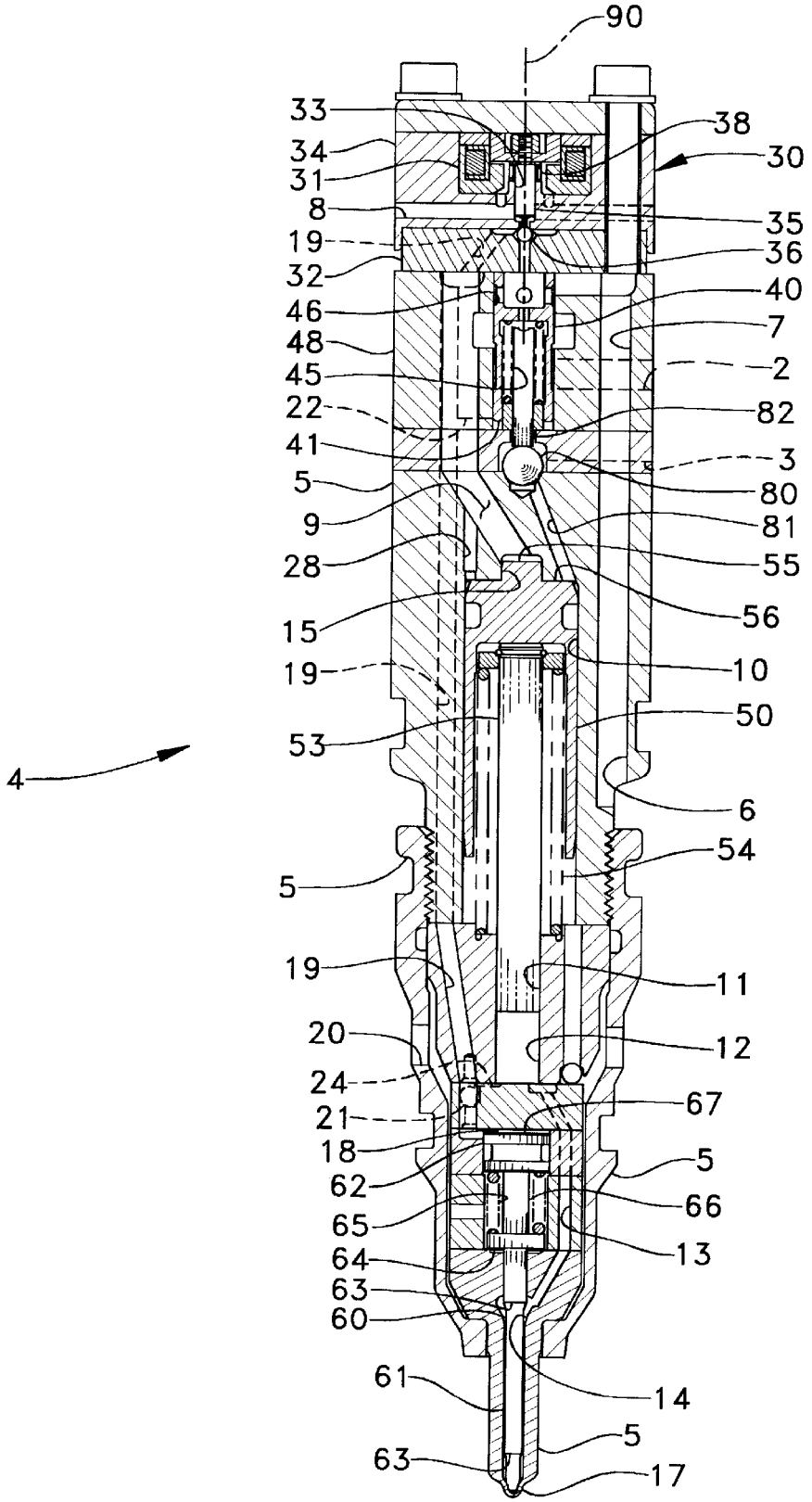
FIG. 1 is a sectioned side elevational view of a fuel injector according to the present invention.
Figure 2:
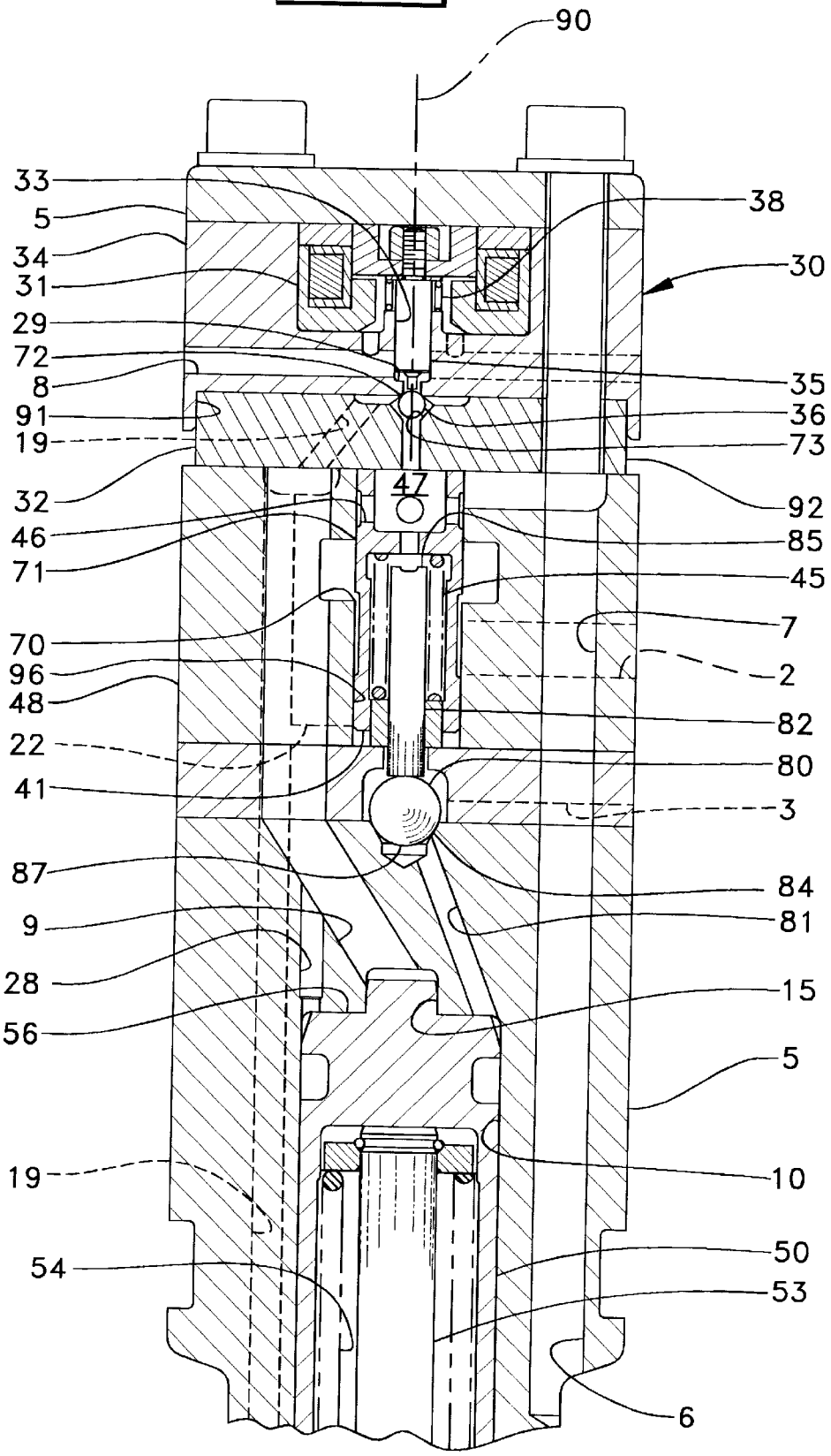
FIG. 2 is a partial sectioned side elevational view of an upper portion of the fuel injector shown in FIG. 1.
Figure 3:
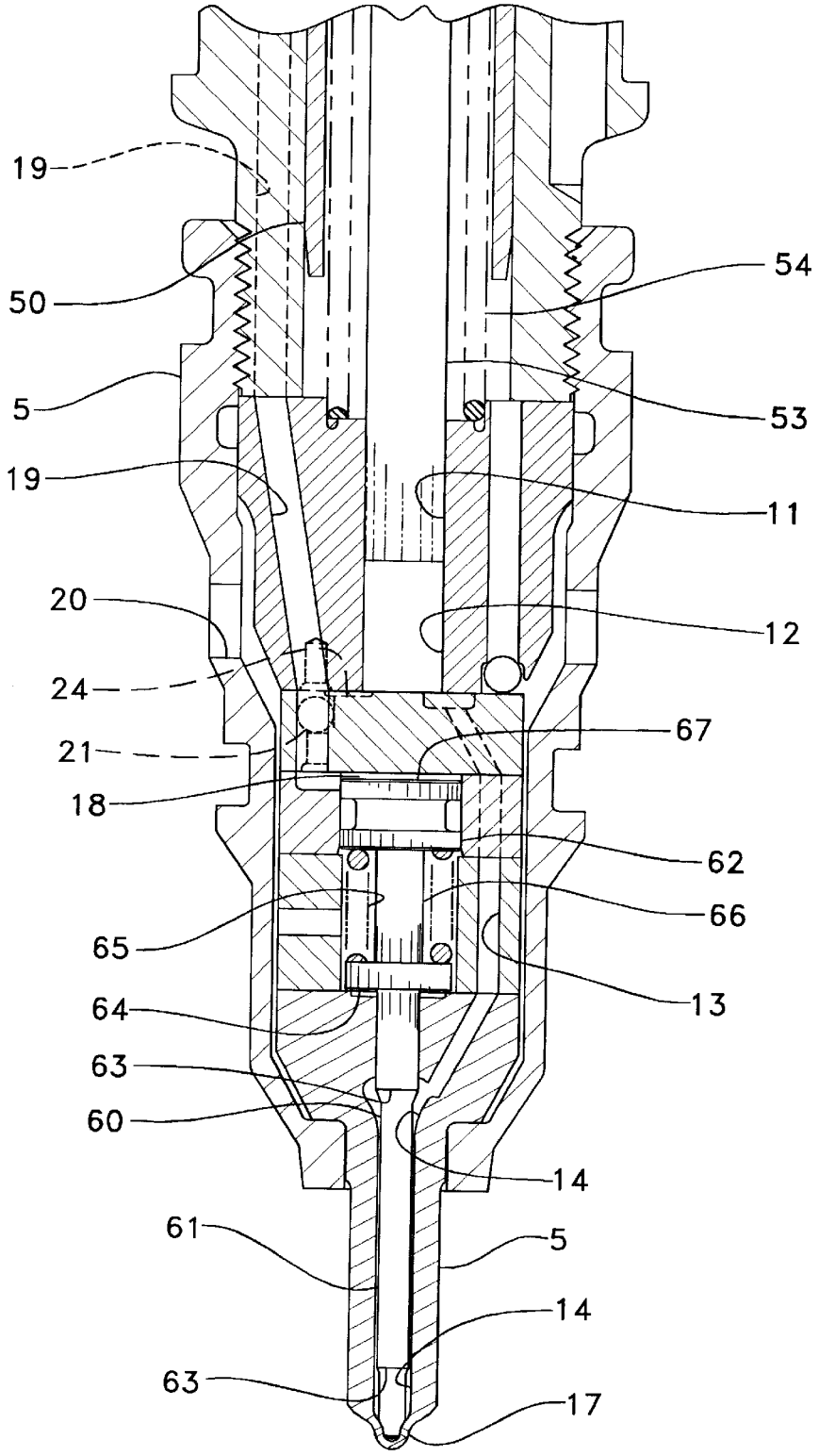
FIG. 3 is a partial sectioned side elevational view of a lower portion of the injector shown in FIG. 1.

Referring now to FIGS. 1–3, fuel injector 4 utilizes a single two-way solenoid 31 to alternately open actuation fluid cavity 9 to actuation fluid inlet 6 or low pressure actuation fluid drain 2, and uses the same solenoid 31 to control the exposure of a needle control chamber 18 to a low pressure passage or a source of high pressure fluid. The single two-way solenoid of injector 4 accomplishes direct control of the needle valve by exploiting a hysteresis effect in the actuation fluid control valve versus the quick response of the needle valve member to the needle control valve. Injector 4 includes an injector body 5 having an actuation fluid inlet 6 that is connected to a source of high pressure actuation fluid, such as lubricating oil, an actuation fluid drain 2 that is connected to a low pressure actuation fluid re-circulation line, and a fuel inlet 20 connected to a source of fuel. Injector 4 includes a hydraulic means for pressurizing fuel within the injector during each injection event and a needle control valve that controls the opening and closing of nozzle outlet 17.

The hydraulic means for pressurizing fuel includes an actuation fluid control valve having a two-way solenoid 31 with an armature attached to a pin 35. An intensifier spool valve member 40 responds to movement of pin 35 and ball valve member 36 to alternately open actuation fluid cavity 9 to actuation fluid inlet 6 or low pressure drain 2. Actuation fluid cavity 9 opens to a stepped piston bore 10, 15 within which an intensifier piston 50 reciprocates between a return position (as shown) and a forward position. Actuation fluid cavity 9 can be thought of as including inner bore 15 and the upper part of bore 10 when piston 50 is in its forward position. Injector body 5 also includes a plunger bore 11, within which a plunger 53 reciprocates between a retracted position (as shown) and an advanced position. A portion of plunger bore 11 and plunger 53 define a fuel pressurization chamber 12, within which fuel is pressurized during each injection event. Plunger 53 and intensifier piston 50 are returned to their retracted positions between injection events under the action of compression spring 54. Thus, the hydraulic means for pressurizing fuel includes the fuel pressurization chamber 12, plunger 53, intensifier piston 50, actuation fluid inlet 6, actuation fluid cavity 9 and the various components of the actuation fluid control valve, which includes solenoid 31, ball 36, pin 35 and intensifier spool valve member 40, etc.

Fuel enters injector 4 at fuel inlet 20 and travels past ball check 21, along a hidden fuel supply passage 24 and into fuel pressurization chamber 12, when plunger 53 is retracting. Ball check 21 prevents the reverse flow of fuel from fuel pressurization chamber 12 into the fuel supply passage during the plunger's downward stroke. Pressurized fuel travels from fuel pressurization chamber 12 via a connection passage 13 to nozzle chamber 14. A needle valve member 60 moves within nozzle chamber 14 between an open position in which nozzle outlet 17 is open and a closed position in which nozzle outlet 17 is closed. In this embodiment, needle valve member 60 includes a lower needle portion 61 and an upper intensifier portion 62 separated by spacers 64 and 66, which are all machined as separate components, but could be machined as a single integral piece if spring 65 were relocated. Needle valve member 60 is mechanically biased to its closed position by a compression spring 65.

Needle valve member 60 includes opening hydraulic surfaces 63 exposed to fluid pressure within nozzle chamber 14 and a closing hydraulic surface 67 exposed to fluid pressure within needle control chamber 18. The closing hydraulic surface and the opening hydraulic surfaces are sized and arranged such that the needle valve member 60 is hydraulically biased toward its closed position when the needle control chamber 18 is open to a source of high pressure fluid. Thus, there should be adequate pressure on the closing hydraulic surface 67 to maintain nozzle outlet 17 closed despite the presence of high pressure fuel (above a valve opening pressure) in nozzle chamber 14. The opening hydraulic surfaces 63 and closing hydraulic surface 67 are also preferably sized and arranged such that needle valve member 60 is hydraulically biased toward its open position when the needle control chamber 18 is connected to a low pressure passage and the fuel pressure within nozzle chamber 14 is greater than the valve opening pressure sufficient to overcome return spring 65.

The actuation fluid control valve of injector 4 can be thought of as including two-way solenoid 31, that is attached to a pin 35, which remains in contact with ball 36 except when pin 35 is fully retracted in order to avoid interference with seat 72. Pin 35 is biased by a compression spring 38, and the hydraulic force on ball 36, toward a retracted position. In this position, ball 36 closes seat 72 and opens seat 73. This allows high pressure actuation fluid to flow into contact with the end hydraulic surface 41 of intensifier spool valve member 40 via a hidden connection passage 22 and a portion of actuation fluid control passage 19. When solenoid 31 is de-energized, actuation fluid cavity 9 is opened to actuation fluid drain 2 past seat 70, and intensifier spool valve member 40 is hydraulically balanced and forced up, as shown, to close seat 71 and open seat 70.

When solenoid 31 is energized, pin 35 moves downward pushing ball 36 to open seat 72 and close seat 73. This causes end hydraulic surface 41 to be exposed to the low pressure in drain passage 29, which is connected to actuation fluid drain 2 outside injector body 5 in part by a second drain passage 8. This creates a hydraulic imbalance in intensifier spool valve member 40 causing it to move along centerline 87 in bore 96 downward against the action of compression spring 45 to close seat 70 and open seat 71. This allows actuation fluid to flow from inlet 6, into the hollow interior 47 of intensifier spool valve member 40, through radial openings 46, past seat 71 and into actuation fluid cavity 9 to act upon the stepped top 55 of the intensifier piston 50.

The opening and closing of the nozzle outlet 17 via needle valve member 60 is controlled by the needle control valve which also includes solenoid 31. As stated earlier, when solenoid 31 is de-energized, pin 35 retracts under the action of compression spring 38 so that high pressure actuation fluid flowing through hollow interior 47 pushes ball 36 to open seat 73 and close seat 72. When in this configuration, the high pressure actuation fluid inlet 6 flows past seat 73 along a hidden passage into actuation fluid control passage 19. Actuation fluid control passage 19 opens to needle control chamber 18 and acts upon the closing hydraulic surface 67 of needle valve member 60, pushing the same downward to close nozzle outlet 17.

When solenoid 31 is energized, pin 35 is moved downward causing ball 36 to close seat 73 and open seat 72. This opens actuation fluid control passage 19 to the low pressure within drain passage 29, which is connected to a second low pressure actuation fluid drain 8. Thus, with the solenoid 31 energized, the closing hydraulic surface 67 of needle valve member 60 is now exposed to a low pressure passage and the needle valve member begins to behave like a simple check valve in that it will now open if fuel pressure within the nozzle chamber 14 is greater than a valve opening pressure sufficient to overcome return spring 65. In this embodiment, the needle control valve includes solenoid 31, pin 35, ball 36, seat 72 and seat 73. The actuation fluid control valve includes all the components of the needle control valve plus intensifier spool valve member 40, compression spring 45, seat 70 and seat 71.

In some instances, when needle valve member 60 abruptly closes nozzle outlet 17 while piston 50 and plunger 53 are moving in their downward stroke, a pressure spike can be created due to the abrupt stopping of the plunger and piston. This pressure spike in the actuation fluid cavity 9 temporarily raises the actuation fluid pressure above that of the common rail pressure leading to high pressure actuation fluid inlet 6. In order to vent pressure spikes from actuation fluid cavity 9, a pressure relief passage 81 extends between actuation fluid cavity 9 to a third low pressure drain 3, which merges with drains 4 and 8 outside of injector body 5. A portion of pressure relief passage 81 is machined into a seat 84 which receives relief ball 80. A relief pin 82 has one end in contact with relief ball 80 and another 85 exposed to the pressure of actuation fluid inlet 6, via hollow interior 47, radial openings 46 and high pressure connection passage 7. Relief ball 80 includes a hydraulic surface 87 exposed to pressure in actuation fluid cavity 9 via pressure relief passage 81 and the upper portion of piston bore 10. Hydraulic surfaces 85 and 87 are sized and arranged such that relief pin 82 holds relief ball 80 in seat 84 when pressure in actuation fluid cavity 9 is above threshold pressure, which is preferably lower than the rail pressure connected to inlet 6. Thus, a pressure relief spike in actuation fluid cavity will open pressure relief passage 81 to vent the pressure spike to the drain.

As is typical, injector body 5 is made up of many machined bodies that include the various passages and bores, and are attached to one another in the manner shown. Of most importance to the present invention is the fact that the actuation fluid control valve assembly 30 is contained within a first body portion 34, a second body portion 32, and a third body portion 48. Solenoid 31 is mounted within first body portion 34 and is centered around a central axis 90. In order to best insure the alignment of annular valve seat 72, and pin guide bore 33, first body portion 34 is originally machined from a circular cylindrical piece of a suitable metallic alloy. The central axis 90 of first body portion 34 is then established. The locating bore 91 is then made centered upon axis 90 and seat 72 is positioned relative to locating bore 91 in order to insure close alignment between the center of seat 72 and the inner diameter of locating bore 91. The pin guide bore 33 is then also made in alignment with axis 90 and is closely aligned with centers of annular valve seat 72 and locating bore 91 because of their relationship to the outer surface of first body portion 34. A disc shaped second body portion 32 has its outer surface machined into a circle that provides a tight fit with the inner diameter of locating bore 91. The high pressure annular valve seat 73 is machined on second body portion 32 relative to its outer diameter. This insures close alignment between the centers of the outer diameter 92 and the annular valve seat 73. When second body portion 32 is attached to first body portion 34 as shown in FIG. 2, the relationship of the various dimensions along with the tight tolerance of locating bore 91 to the outer diameter of second body portion 32, insures the close alignment between the centers of pin guide bore 33, the first annular valve seat 72 and the lower annular valve seat 73.

The valve assembly contained within first body portion 34 and second body portion 32 could be thought of as a needle control valve for fuel injector 4. In particular, the needle control valve includes solenoid 31, pin 35, ball 36, seat 72 and seat 73. The various components of the needle control valve also are portions of a larger valve assembly 30 that includes the contents of the third body portion 48. The contents of the three body portions can be thought of as the actuation fluid control valve for injector 4, which includes the various components of the needle control valve plus spool valve member 40, spring 45, seat 70, and seat 71.

Industrial Applicability

Each injection sequence is started by energizing solenoid 31 in order to move ball 36 to open seat 72 and close seat 73. The pressurized fluid previously acting on the end hydraulic surface 41 of spool valve member 40 can now drain past seat 72. Intensifier spool valve member 40 is now hydraulically imbalanced and begins to move downward against the action of compression spring 45. This opens seat 71 and closes seat 70. The main oil supply can now flow through radial openings 46, past seat 71, into actuation fluid cavity 9 to the top of intensifier piston 50, starting it moving downward. With intensifier piston 50 and plunger 53 moving downward, fuel pressure starts to build within fuel pressurization chamber 12, closing ball check 21. With the solenoid energized, needle control passage 19 is open to low pressure drain 29 such that needle valve member 60 will open when fuel pressure exceeds a valve opening pressure sufficient to compress return spring 65.

Since only the inner top portion 55 of intensifier piston 50 is exposed to the high pressure oil in actuation fluid cavity 9, the intensifier piston accelerates downward at a rate lower than it otherwise would if the full fluid pressure were acting over the complete top surface of the intensifier piston. The volume above the annular top surface 56 of intensifier piston 50 is filled by fluid flowing through auxiliary passage 28. As the intensifier piston continues to move downward, it eventually reaches a point where the volume above space 56 is growing faster than fluid can be supplied via passage 28. This causes a momentary hesitation in the piston's downward movement resulting in a slower build-up of fuel pressure underneath plunger 53 in fuel pressurization chamber 12.

If a "ramp-square" injection profile is desired, current to solenoid 31 is continued throughout the duration of the injection event. After the ball and spool have moved due to the initial energization of solenoid 31, the solenoid current is dropped to a hold-in current which keeps the solenoid pin in its same position yet saves energy since less energy is required to hold pin 35 in this position. Because of the slower acceleration and hesitation produced in the movement of intensifier piston 50 by the use of a stepped piston top in a stepped bore, the initial mass injection rate desirably ramps upward in a way that improves exhaust emissions over certain engine operating conditions.

To end injection and allow the injector to re-fuel itself for the next cycle, solenoid 31 is de-energized. This causes ball 36 to move to open seat 73 and close seat 72. This resumes the pressurized oil acting on closing hydraulic surface 67 and, with the help of return spring 65, causes needle valve member 60 to close and provide an abrupt end to the injection. The opening of seat 73 causes intensifier pool valve member 40 to again become hydraulically balanced so that compression spring 45 begins to move the same upward to close seat 71 and open seat 70. This allows actuation fluid in actuation fluid cavity 9 to drain into actuation fluid drain 2 so that intensifier piston 50 and plunger 53 can retract under the action of return spring 54. The lowering of fuel pressure within fuel pressurization chamber 12 causes ball check 21 to open. Replenishing fuel begins to flow into the injector for the next injection event. Thus, in this injector, simple energizing and de-energizing of the solenoid will result in a ramped initial injection rate due to the intensifier piston stepped top and an abrupt end to injection due to the direct needle valve member control features.

The present invention is also capable of far more complex injection rate profiles than a simple "ramp-square". For instance, injector 4 can be made to produce a pilot injection segment at any pressure between valve opening pressure and maximum fuel pressure. A "square" injection could be added to the pilot injection by holding the needle valve closed until fuel pressure is close to its maximum. In order to produce such an injection rate profile, solenoid 31 is initially energized with a maximum current so that ball 36 moves to open seat 72 and close seat 73. Shortly after the ball moves, the intensifier spool valve member begins to move from its closed position to its open position so that high pressure actuation fluid begins to flow into actuation fluid cavity 9, beginning the piston and plunger moving in their downward stroke. When fuel pressure within nozzle chamber exceeds the valve opening pressure sufficient to compress return spring 65, the needle valve member briefly opens to allow a pilot injection segment to occur.

In order to produce a split injection, the solenoid is briefly de-energized a sufficient amount of time that the ball 36 moves back to its original position to open seat 73 and close seat 72. This again pressurizes the closing hydraulic surface 67 of needle valve member 60 causing it to close. At the same time, intensifier spool valve member 40 becomes hydraulically balanced and begins to move to close seat 70. However, because spring 45 is relatively weak, the intensifier spool valve member moves rather slowly. Before intensifier spool valve member moves sufficiently far to close seat 70, the solenoid is again energized causing ball 36 to again close seat 73 and re-open seat 72. This allows needle valve member to re-open with fuel pressure substantially higher than the valve opening pressure in order to provide an abrupt beginning, or "square" to the injection. At the same time, intensifier spool valve member 40 reverses direction and returns to its fully open position. Thus, since ball 36 and needle valve member 60 can react far quicker to the movement of solenoid 31, the needle control valve can be opened and closed faster than the intensifier spool valve member can react to close seat 71 during an injection event.

Those skilled in the art should appreciate that while the present invention has been illustrated as having the locating bore made in the first body portion 34, the locating bore could alternatively be made in the second body portion 32. The improved axis alignment of the present invention is possible because the various key dimensions, pin guide bore, the low pressure annular seat, and the high pressure annular seat are positioned relative to one another, by linkage to other common dimension(s). Those skilled in the art will appreciate that other machining techniques can be utilized to link the positioning of the key dimensions. By improving alignment, the potential for pin breakage is minimized, thus adding to the robustness of the fuel injector.

Other aspects, objects, and advantages of this invention can be obtained from a study of the drawings, the disclosure, and the appended claims.

I claim:

1. A valve assembly comprising:

a first body with a first annular valve seat and a pin guide bore centered about an axis;

a second body attached to said first body and having a second annular valve seat centered about said axis and located in a position opposite to said first annular valve seat;

a ball positioned to move between said first annular valve seat and said second annular valve seat;

a pin mounted to move in said pin guide bore along said axis such that one end can contact said ball;

a spring operably positioned to bias said pin to a position out of contact with said ball;

one of said first body and said second body having a locating bore centered on said axis, and the other of said first body and said second body having a part sized to be tightly received in said locating bore; and a location of said pin guide bore being linked to a location of said second annular valve seat via a fit of one of said first body and said second body in said locating bore.

2. The valve assembly of claim 1 wherein said locating bore is circular with an inner diameter; and said part is cylindrical and circular with an outer diameter slightly smaller than said inner diameter.

3. The valve assembly of claim 2 further comprising a solenoid with an armature attached to an opposite end of said pin.

4. The valve assembly of claim 3 wherein said first body has said locating bore; and said second body has said cylindrical portion.

5. The valve assembly of claim 4 wherein said second body is disc shaped; and said first body has a circular cylindrical outer surface parallel to said axis.

6. A valve assembly comprising a first body with a first annular valve seat and a pin bore centered about an axis;

a second body attached to said first body and having a second annular valve seat centered about said axis and located in a position opposite to said first annular valve seat;

a ball positioned to move between said first annular valve seat and said second annular valve seat;

a pin mounted to move in said pin bore along said axis such that one end can contact said ball;

one of said first body and said second body having a locating bore centered on said axis, and the other of said first body and said second body having a part sized to be tightly received in said locating bore;

said locating bore being circular with an inner diameter;

said part is cylindrical and circular with an outer diameter slightly smaller than said inner diameter a solenoid with an armature attached to an opposite end of said pin;

a third body attached to said second body and having a spool bore;

a spool valve member mounted to reciprocate in said spool bore between a first position and a second position, and having an end hydraulic surface exposed to pressure in a control passage; and at least one of said first body, said second body and said third body having said control passage extending between said end hydraulic surface and said ball.

7. The valve assembly of claim 6 wherein said first body includes a low pressure passage extending from said first annular valve seat away from said ball;

said second body includes a high pressure passage extending from said second annular seat away from said ball;

said control passage being open to said low pressure passage when said ball is seated in said second annular seat; and said control passage being open to said high pressure passage when said ball is seated in said first annular seat.

8. The valve assembly of claim 7 wherein said spool bore of said third body opens to an inlet passage, a drain passage and a cavity;

said cavity being open to said inlet passage and closed to said drain passage when said spool valve member is in said first position;

said cavity being open to said drain passage and closed to said inlet passage when said spool valve member is in said second position; and means, including a spring, for biasing said spool valve member toward said second position.

9. A fuel injector comprising:

an injector body having a first body portion, a second body portion and a nozzle chamber that opens to a nozzle outlet;

hydraulic means, within said injector body, for pressurizing fuel in said nozzle chamber;

a needle valve member positioned to reciprocate in said nozzle chamber between an opened position in which said nozzle outlet is open and a closed position in which said nozzle outlet is closed;

said first body portion having a first annular valve seat and a pin guide bore centered about an axis;

said second body portion being attached to said first body portion and having a second annular valve seat centered about said axis and located in a position opposite to said first annular valve seat;

a ball positioned to move between said first annular valve seat and said second annular valve seat;

a pin mounted to move in said pin guide bore along said axis such that one end can contact said ball;

a spring operably positioned to bias said pin to a position out of contact with said ball; and one of said first body portion and said second body portion having a locating bore centered on said axis, and the other of said first body portion and said second body portion having a part sized to be tightly received in said locating bore; and a location of said pin guide bore being linked to a location of said second annular valve seat via a fit of one of said first body and said second body in said locating bore.

10. The fuel injector of claim 9 wherein said injector body further includes a needle control chamber;

said needle valve member further including a closing hydraulic surface exposed to pressure in said needle control chamber; and a needle control valve mounted within said injector body and having an on position in which said needle control chamber is open to a low pressure passage and an off position in which said needle control chamber is open to a high pressure passage.

11. The fuel injector of claim 10 wherein said hydraulic means for pressurizing includes:

said injector body having a plunger bore and an actuation fluid cavity that opens to an actuation fluid inlet, an actuation fluid drain and a piston bore;

an actuation fluid control valve, which includes said first annular valve seat, said second annular valve seat, said ball and said pin, and having a first position in which said actuation fluid cavity is open to said actuation fluid inlet and a second position in which said actuation fluid cavity is open to said actuation fluid drain;

an intensifier piston positioned to reciprocate in said piston bore between a forward position and a return position;

a plunger positioned to reciprocate in said plunger bore between a retracted position and an advanced position; and a portion of said plunger bore and said plunger define a fuel pressurization chamber that is open to said nozzle chamber.

12. The fuel injector of claim 9 wherein said locating bore is circular with an inner diameter; and said part is cylindrical and circular with an outer diameter slightly smaller than said inner diameter.

13. The fuel injector of claim 12 further comprising a solenoid mounted to said injector body and having an armature attached to an opposite end of said pin.

14. The fuel injector of claim 13 wherein said first body portion has said locating bore; and said second body portion has said cylindrical portion.

15. The fuel injector of claim 14 wherein said second body portion is disc shaped; and said first body portion has a circular cylindrical outer surface parallel to said axis.

16. The fuel injector of claim 13 wherein said injector body further includes a third body portion attached to said second body portion and having a spool bore;

a spool valve member mounted to reciprocate in said spool bore between a first position and a second position, and having an end hydraulic surface exposed to pressure in a control passage; and at least one of said first body portion, said second body portion and said third body portion having said control passage extending between said end hydraulic surface and said ball.

17. The fuel injector of claim 16 wherein said first body portion includes a low pressure passage extending from said first annular valve seat away from said ball;

said second body portion includes a high pressure passage extending from said second annular seat away from said ball;

said control passage being open to said low pressure passage when said ball is seated in said second annular seat; and said control passage being open to said high pressure passage when said ball is seated in said first annular seat.

18. The fuel injector of claim 17 wherein said actuation fluid cavity being open to said actuation fluid inlet and closed to said actuation fluid drain when said spool valve member is in said first position;

said actuation fluid cavity being open to said actuation fluid drain and closed to said actuation fluid inlet when said spool valve member is in said second position; and means, including a spring, for biasing said spool valve member toward said second position.

19. The fuel injector of claim 18 wherein said injector body further includes a needle control chamber;

said needle valve member further including a closing hydraulic surface exposed to pressure in said needle control chamber; and a needle control valve mounted within said injector body and having an on position in which said needle control chamber is open to a low pressure passage and an off position in which said needle control chamber is open to a high pressure passage.

20. The fuel injector of claim 19 wherein said hydraulic means for pressurizing includes:

said injector body having a plunger bore and a piston bore;

an actuation fluid control valve which includes said first annular valve seat, said second annular valve seat, said ball, said pin, said spool valve member and said spring;

an intensifier piston positioned to reciprocate in said piston bore between a forward position and a return position;

a plunger positioned to reciprocate in said plunger bore between a retracted position and an advanced position; and a portion of said plunger bore and said plunger define a fuel pressurization chamber that is open to said nozzle chamber.

* * * * *